United States Patent [19]

Toda et al.

[11] Patent Number: 4,748,428

[45] Date of Patent: May 31, 1988

[54] MULTI-POLE CIRCUIT INTERRUPTER

[75] Inventors: Haruhisa Toda; Toshiyuki Tanibe; Hiroaki Fugihisa, all of Fukuyama, Japan

[73] Assignee: Mitsubishi Denki Kabushiki Kaisha, Japan

[21] Appl. No.: 79,700

[22] Filed: Jul. 30, 1987

[30] Foreign Application Priority Data

Aug. 4, 1986 [JP] Japan ..... 61-120177[U]

[51] Int. Cl.[4] ..... H01H 75/02

[52] U.S. Cl. ..... 335/10; 337/46; 335/190

[58] Field of Search ..... 335/8, 9, 10, 16, 176, 335/190, 147; 200/174; 337/45, 46, 47, 48

[56] References Cited

U.S. PATENT DOCUMENTS

| | | | |
|---|---|---|---|
| 3,492,609 | 1/1970 | Murai et al. | 335/16 |
| 4,166,988 | 9/1979 | Ciarcia et al. | 335/9 |
| 4,227,161 | 10/1980 | Yamat et al. | 335/16 |

*Primary Examiner*—L. T. Hix
*Assistant Examiner*—Brian W. Brown
*Attorney, Agent, or Firm*—Leydig, Voit & Mayer

[57] ABSTRACT

A multi-pole circuit interrupter having a first pole unit provided with an operating mechanism and a second pole unit provided with no operating mechanism. Each of the pole units comprises a movable contact, a stationary contact, and a contact arm assembly for supporting the movable contact of the respective pole unit including a first contact arm and a second contact arm pivotally supported by a common pin. The first contact arm in the first pole unit have an elongated guide hole extending in a direction of movement of the movable contact and is directly connected to the operating mechanism. The second contact arm has an elongated hole extending substantially in a longitudinal direction thereof. A spring-biased sliding pin extends through the elongated hole and the guide hole. The guide hole of the second pole unit extends further upwards than the guide hole of the first pole unit so that the sliding pin in the first pole unit starts to slide along the pin braking surface of the guide hole only after the sliding pin in the second pole unit has left the pin breaking surface and moves on the pin sliding surface. As a result, a time delay between the resetting movements of the sliding pin along the pin braking surface of the guide hole in the first and second pole units is provided.

3 Claims, 8 Drawing Sheets

MULTI-POLE CIRCUIT INTERRUPTER

BACKGROUND OF THE INVENTION

This invention relates to a multi-pole circuit interrupter in which a first pole unit with an operating mechanism and a second pole unit without an operating mechanism are provided and in which a movable contact is moved to open by an electromagnetic repulsive force resulting from a large current irrespective of the interrupting operation by an automatic trip mechanism.

A conventional circuit interrupter to which the present invention pertains will be described in conjunction with FIGS. 1 to 8. FIG. 1 is a plan view of a conventional multi-pole circuit interrupter; FIG. 2 is an enlarged cross sectional view taken along line II—II of FIG. 1; FIG. 3 is a partial enlarged sectional view of FIG. 2 showing the ON position; FIG. 4 is a view similar to FIG. 3, but illustrating the OFF position; FIG. 5 is a view similar to FIG. 3, but illustrating the TRIP position; FIG. 6 is a view similar to FIG. 3, but illustrating the electromagnetically operated position; FIG. 7 is an enlarged cross sectional view taken along line VII—VII of FIG. 1 illustrating the on position; and FIG. 8 is an enlarged view of a portion of FIG. 7 but illustrating the off position.

In FIG. 1, the multi-pole circuit interrupter is illustrated as having a housing 1 in which a central, first pole unit 2 provided with an operating mechanism is positioned between a pair of side, second pole units 3 provided with no operating mechanism. The first pole unit 2 has formed therein a window 5 through which an operating handle 4 of the operating mechanism extends.

In FIGS. 2 to 6, which illustrate detailed arrangements of the first pole unit 2 in various operating positions, the electrically insulating housing 1 includes a base 1*a* and a cover 1*b*. A stationary source side conductor 6 is mounted on the base 1*a* and has a stationary contact 7 secured thereon. An automatic trip unit 8 is mounted in the housing 1, and a load side conductor 9 is electrically connected to the automatic trip unit 8. A movable contact 10 is secured to a movable member 11 which is electrically connected to the automatic trip unit 8 through a flexible conductor 12 and a connector 13. The movable member 11 is supported by a contact arm assembly 14 comprising a first contact arm 14*a* connected to an operating mechanism 23 which will be described in more detail later, and a second contact arm 14*b* on which the movable member 11 is pivotally supported by a first pin 15. The first contact arms 14*a* for all of the pole units 2 and 3 are also connected to a cross bar 17 for the simultaneous movement of the pole units 2 and 3. The first contact arm 14*a* and second contact arm 14*b* are pivotally supported independently within the housing by a pivot pin 16.

The first contact arm 14*a* has formed therein a first guide hole 18 extending substantially in a direction of movement of the first contact arm 14*a*. The guide hole 18 includes a recessed portion 18*a* in which a sliding pin 20 is received and an end portion 18*b* against which the sliding pin 20 engages upon the separation of the contacts by electromagnetic repulsion. The guide hole 18 also includes a pin braking portion 180 which is formed in a pin sliding surface 18*c* along which the sliding pin 20 slides and which is a slanted surface for preventing the bouncing of the sliding pin 20 when it hits the end portion 18*b* of the guide hole 18.

The second contact arm 14*b* has formed therein a second elongated guide hole 19 extending in a direction of extension of the second contact arm 14*b* and in a direction generally perpendicular to the direction of extension of the first guide hole 18. The sliding pin 20 extends through th first and the second guide holes 18 and 19 to limit the relative pivotal movement between the first and second contact arms 14*a* and 14*b*. The sliding pin 20 is biased toward the free end of the contact arm 14*b* by a tension spring 21 mounted between the sliding pin 20 and a pin 15 pivotally connecting the movable member 11 to the second contact arm 14*b*. In order to provide a contact biasing force between the movable and stationary contacts 10 and 7, a contact pressure spring 22 is disposed between the movable member 11 and the second contact arm 14*b*. An operating handle 4 is connected to an operating mechanism 23 comprising a releasable cradle 23*a* having a stop pin 24 and a pair of toggle links 23*b* and 23*c* connected between the cradle 23*a* and the first contact arm 14*a* by pivot pins 25*a* and 25*b*. As is well known, an arc extinguisher 26 is disposed in such a way as to extinguish the arc generated between the separated contacts when they are separated. In FIGS. 7 and 8, which illustrate detailed arrangements of the second pole unit 3 in ON and OFF operating positions, the cover 1*b* of the housing 1 is integrally provided with a stopper 27 for limiting the movement of the second contact arm 14*b*.

When the first pole unit 2 with the operating mechanism 23 of the circuit interrupter is in the ON position shown in FIGS. 2 to 3, an electric current flows from the source side stationary conductor 6 to a load side conductor 9 through the stationary contact 7, the movable contact 10, the movable member 11, the flexible conductor 12, the connector 13 and the automatic trip unit 8 in the named order. When the second pole unit 3 without the operating mechanism 23 is in the ON position shown in FIGS. 1 and 7, the electric current flows from the source side stationary conductor 6 to the load side conductor 9 through the stationary contact 7, the movable contact 10, the movable member 11, the flexible conductor 12 and the connector 13 in the named order.

When the operating handle 4 is moved into the OFF position as shown by an arrow 28 of FIG. 3, the contact arm assembly 14 is lifted by the operating mechanism 23 so that the movable contact 10 together with the movable member 11 is moved away from the stationary contact 7 as shown in FIG. 4 to open the contacts 7 and 10. At this time, since the sliding pin 20 is positioned in the recessed portion 18*a* of the guide hole 18 due to the biasing function of the tension spring 21, the second contact arm 14*b* is rotated about the pivot pin 16 in the opening direction by the operating mechanism 23 together with the first contact arm 14*a* until it abuts against the stop pin 24. This movement of the contact arm assembly 14 of the first pole unit 2 with the operating mechanism is transmitted through the cross bar 17 to the second pole unit 3 without the operating mechanism so that the contact arm assembly 14 therein opens until the second contact arm 14*b* of that pole unit abuts against the stopper 27 mounted on the cover 1*b*.

In the ON position shown in FIGS. 1 to 3 and 7, when an overload current flows through the circuit interrupter, the automatic trip unit 8 is actuated to release the cradle 23*a* of the operating mechanism 23 to allow it to rotate in the direction of an arrow 29 of FIG. 3. Then, the toggle links 23*b* and 23*c* of the operating mechanism 23 rotate the contact arm assembly 14 in the clockwise direction in the figure to separate the movable contact 10 from the stationary contact 7, thereby interrupting the overload current. This is the so-called tripped position shown in FIG. 5. During this operation, since the sliding pin 20 is positioned within the recessed portion 18*a* of the guide hole 18 due to the action of the tension spring 21 similarly to the OFF position shown in FIG. 4, the second contact arm 14*b* is rotated clockwise about the pivot shaft 16 by the operating mechanism 23 together with the first contact arm 14*a* until it abuts against the stop pin 24. Although not illustrated, the contact arm assembly 14 in the second pole unit 3 is also separated because of the movement of the cross bar 17 until the second contact arm 14*b* abuts against the stopper 27 on the cover 1*b* of the housing in a similar manner to that previously described.

When a large current such as a short-circuit current flows through the circuit interrupter in the ON position shown in FIGS. 2 to 3 and 7, an electromagnetic repulsive force generated between the stationary conductor 6 and the movable member 11 causes the movable member 11 to immediately separate from the stationary conductor 6 as shown in FIG. 6. At this time, since the operating mechanism 23 does not allow the first contact arm 14*a* to be actuated because it has not yet been actuated itself, the second contact arm 14*b* rotates clockwise about the pivot pin 16 by moving the sliding pin 20 against the spring force of the tension spring 21 from the recessed portion 18*a* of the guide hole 18 along a pin sliding surface 18*c* in the guide hole 18 until the sliding pin 20 abuts against an end portion 18*b* of the guide hole 18 as shown in FIG. 6. Also in the second pole unit 3 in which no operating mechanism is provided, the movable member 11 also moves in the opening direction due to the repulsive force as shown in FIG. 8 until the sliding pin 20 abuts against the end portion 18*b* of the guide hole 18. In either pole unit 2 or 3, the sliding pin 20 is subjected to a braking force from the pin braking portion 180 of the guide hole 18, so that the sliding pin 20 cannot bounce back at the end portion 18.

An electromagnetic repulsive force is generated very quickly upon the occurence of a short-circuit current and therefore the contact separation is achieved before the automatic trip unit 8 is actuated, providing a high current limiting capability. Immediately after the electromagnetic repulsive separation is achieved, the automatic trip unit 8 trips and rotates the first contact arm 14*a* to return the sliding pin 20 into the recessed portion 18*a* along the pin sliding surface 18*c* of the guide hole 18 after it has passed the position shown in FIG. 6 to take up the tripped position shown in FIG. 5. This is called the resetting of the contact arm assembly 14. At this time since the first contact arm 14*a* of the contact arm assembly 14 in the second pole unit 3 is tripped through the cross bar 17 and lifted from the repulsion position of FIG. 8, the sliding pin 20 also moves along the pin sliding surface 18*c* across the pin braking portion 180 until it is received within the recessed portion 18*a* to take up a tripped position. This repulsive action is quicker than the action of the operating mechanism 23 connected to the movable member 11 through the contact arm assembly 14, thereby increasing the current limiting effect.

With the conventional multi-pole circuit interrupter as above described, the time points at which the sliding pins 20 of respective pole units 2 and 3 move over the corresponding pin braking portions 180 of the respective guide holes 18 during the resetting of the first contact arms 14*a* are concurrent to each other, requiring a large force to reset the first contact arms 14*a* so that the operating mechanism 23 must be made large-sized.

SUMMARY OF THE INVENTION

Accordingly, an object of the present invention is to provide a multi-pole circuit interrupter in which the contact arm assembly may be easily reset.

Another object of the present invention is to provide a multi-pole circuit interrupter which may be reset with a small force without increasing the physical dimensions of the operating mechanism.

With the above objects in view, the multi-pole circuit interrupter of the present invention includes at least a first pole unit provided with an operating mechanism and a second pole unit provided with no operating mechanism. Each pole unit is provided with a movable contact arm assembly, having a pair of first and second contact arms pivotally supported by a common pivot pin. The first contact arm has an elongated guide hole extending in a direction of movement of the movable contact, and the second contact arm has an elongated hole extending substantially in a direction of extension of the second contact arm. A spring biased sliding pin extends through said elongated hole and said guide hole. The guide hole has a pin braking surface for braking the movement of the sliding pin upon the repulsion of the contact arms. The guide hole is arranged to provide a time delay between the resetting movements of said sliding pins in the first and the second pole units.

BRIEF DESCRIPTION OF THE DRAWINGS

The present invention will become more readily apparent from the following detailed description of the preferred embodiment of the present invention taken in conjunction with the accompanying drawings, in which.

DESCRIPTION OF THE PREFERRED EMBODIMENT

Figure 1:
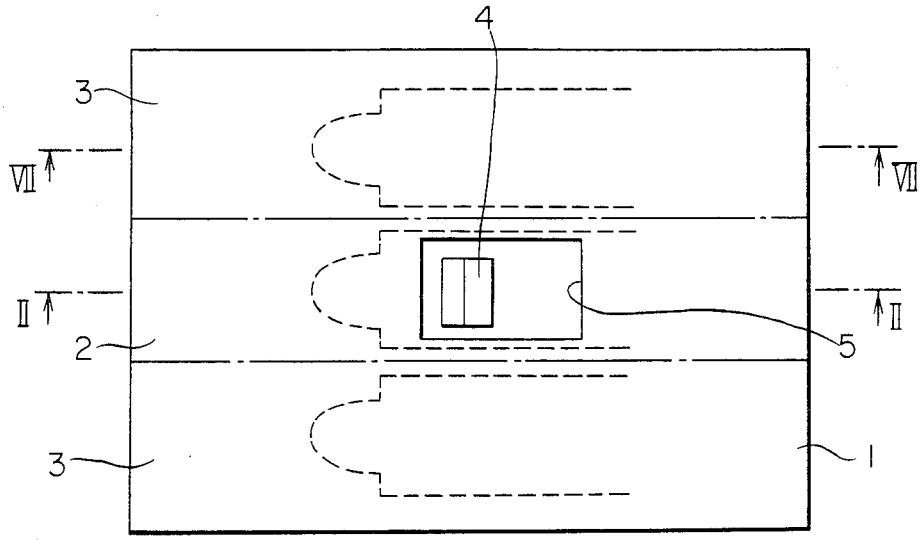
FIG. 1 PRIOR ART
FIG. 1 is a plan view of a conventional multi-pole circuit interrupter.
Figure 2:
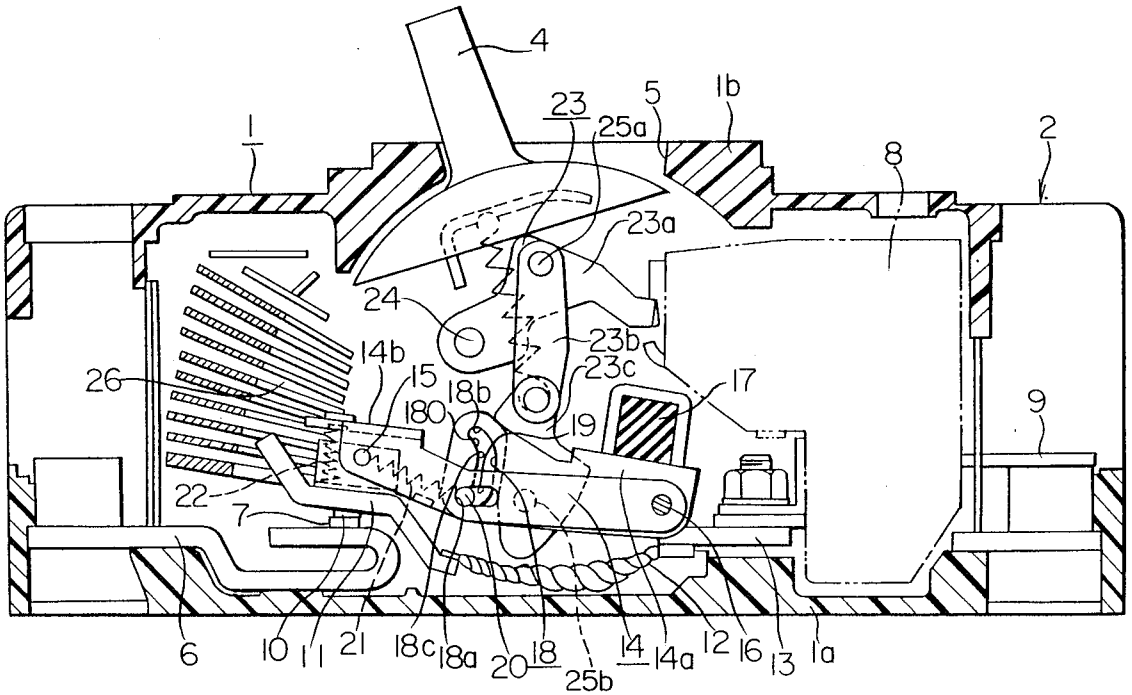
FIG. 2 PRIOR ART
FIG. 2 is an a enlarged cross sectional view taken along line II—II of FIG. 1.
Figure 3:
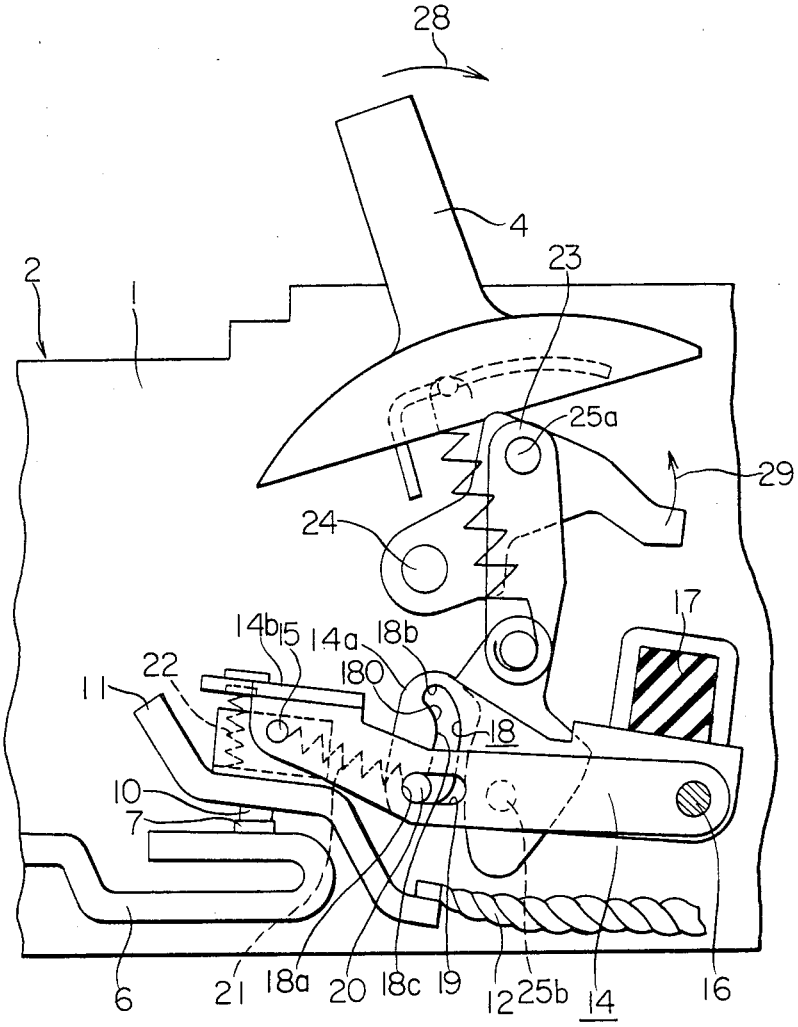
FIG. 3 PRIOR ART
FIG. 3 is a partial enlarged sectional view of FIG. 2 showing the ON position.
Figure 4:
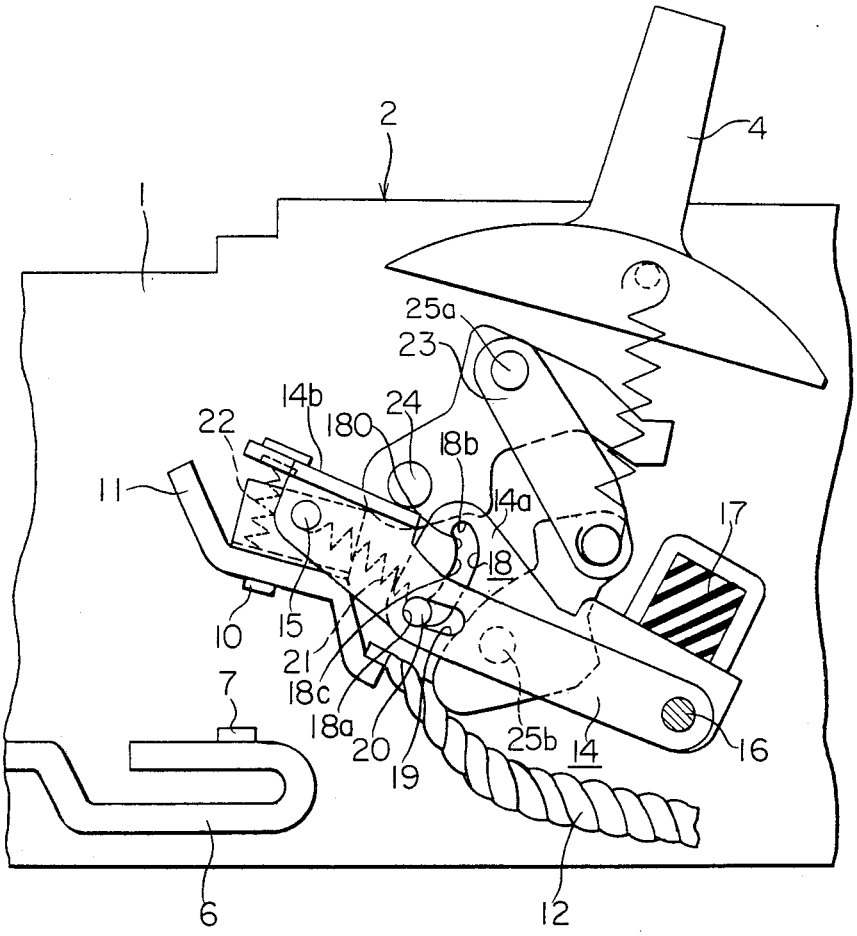
FIG. 4 PRIOR ART
FIG. 4 is a view similar to FIG. 3, but illustrating the OFF position.
Figure 5:
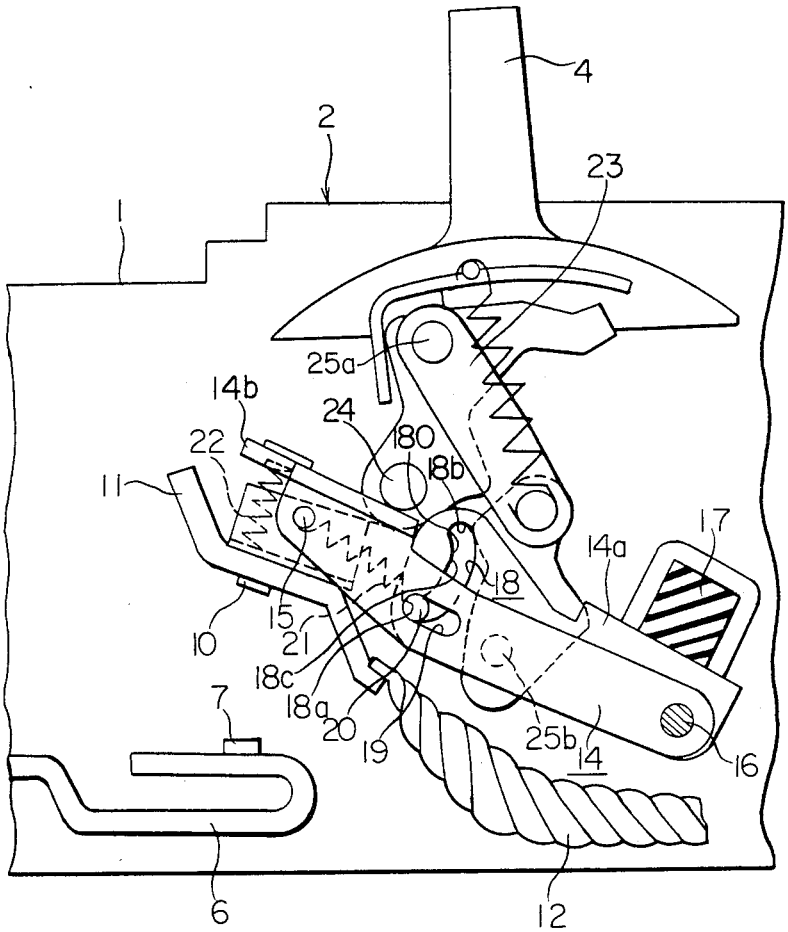
FIG. 5 PRIOR ART
FIG. 5 is a view similar to FIG. 3, but illustrating the TRIP position.
Figure 6:
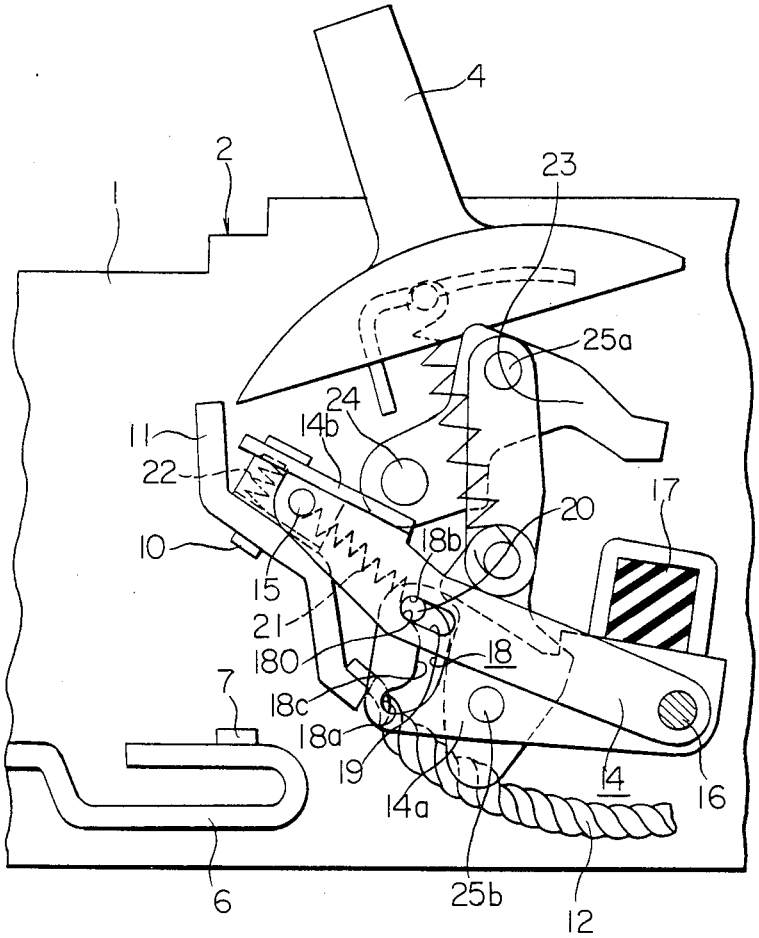
FIG. 6 PRIOR ART
FIG. 6 is a view similar to FIG. 3, but illustrating the electromagnetically operated position.
Figure 7:
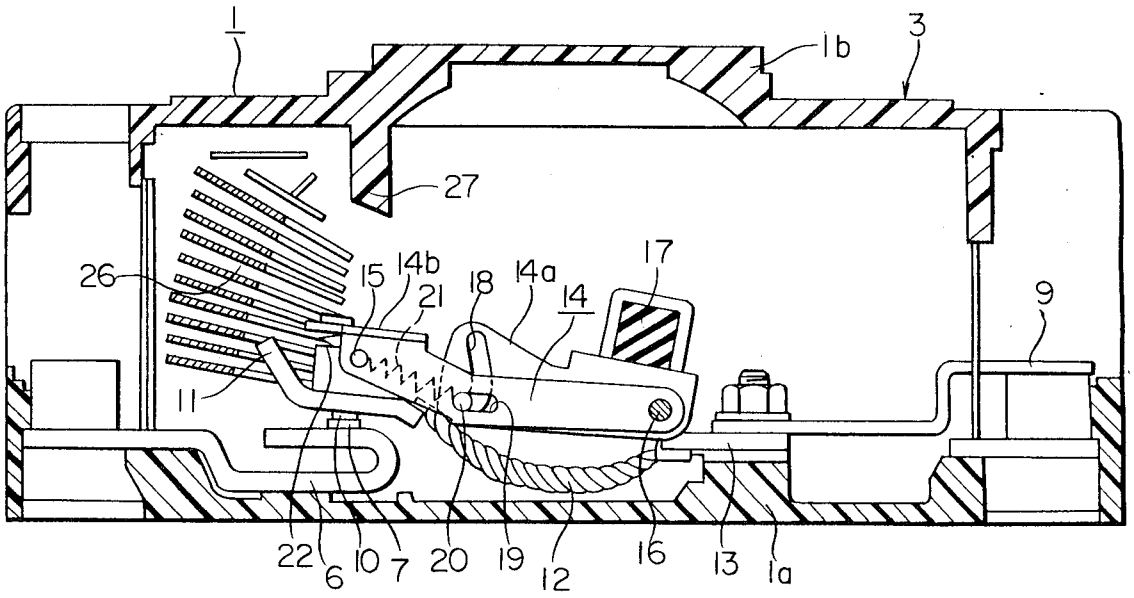
FIG. 7 PRIOR ART
FIG. 7 is an enlarged cross sectional view taken along line VII—VII of FIG. 1.
Figure 8:
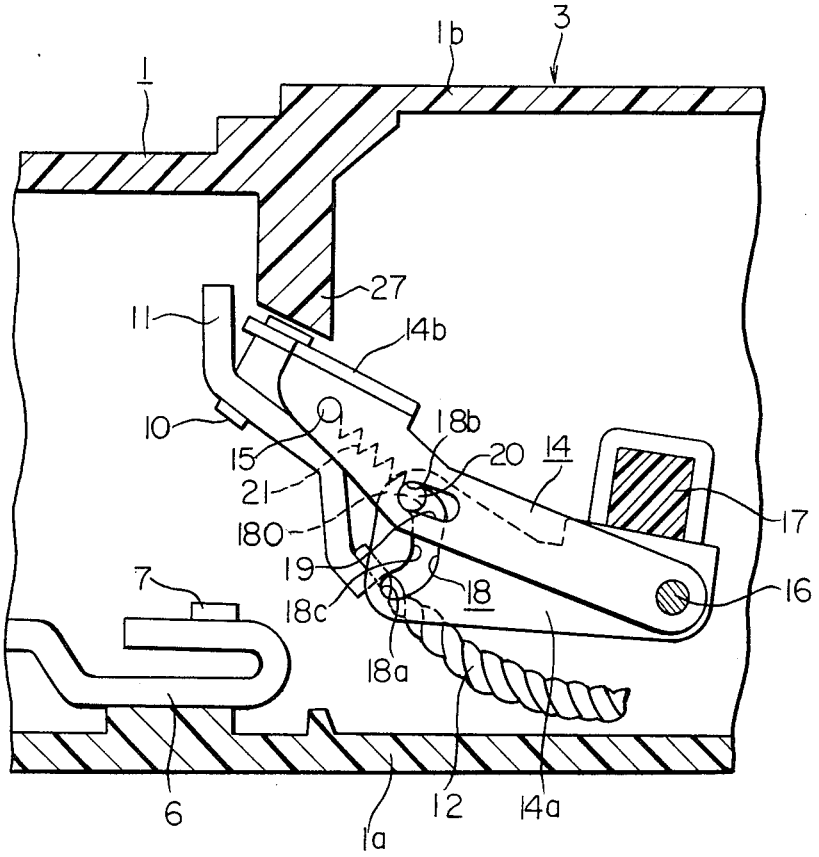
FIG. 8 PRIOR ART
FIG. 8 is an enlarged view of a portion of FIG. 7 illustrating the OFF position.
Figure 9:
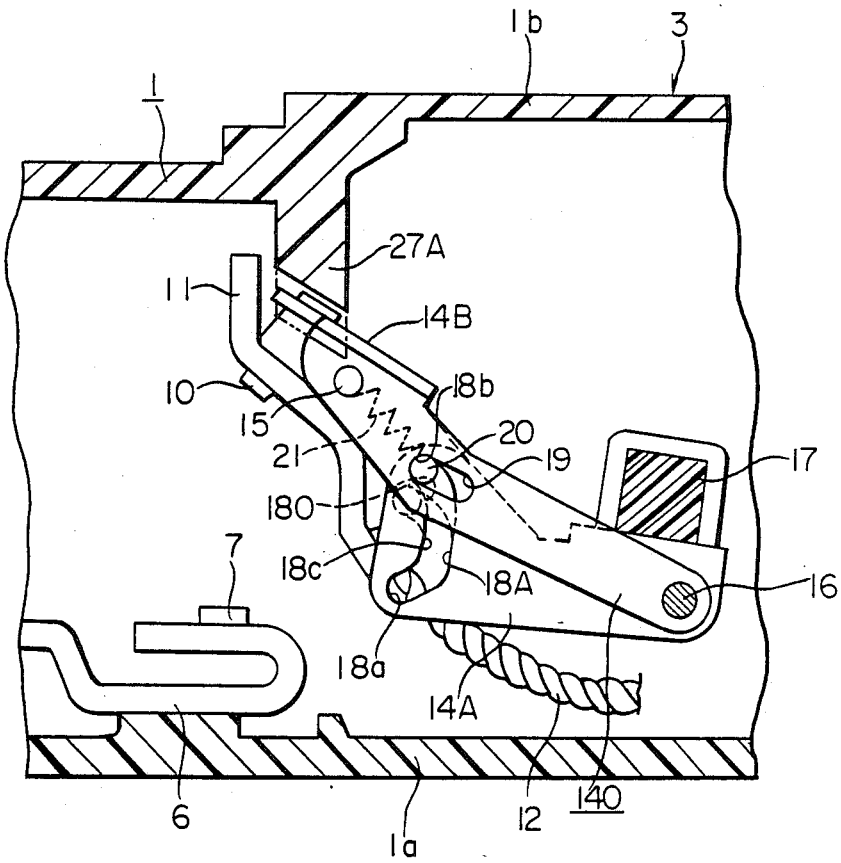
FIG. 9 is an enlarged view of a contact arm assembly of one embodiment of a multi-pole circuit interrupter of the present invention.

FIG. 9 illustrating one embodiment of the present invention is a view similar to FIG. 8 in which the repulsion position of the second pole unit 3 without the operating mechanism is shown, and the same reference numerals designate components identical with or corresponding to those used in FIG. 8. According to the present invention, a first contact arm 14A of a contact arm assembly 140 of the second pole unit 3 has a guide hole 18A which extends further upwards and is longer than the guide hole 18 in the contact arm **14*a* of the second pole unit 3 in the conventional circuit interrupter, while the guide hole of the first contact arm of the first pole unit 2 is equal to that of the prior art. For easy comparison, in FIG. 9, guide hole 18A in the first contact arm 14A of the contact arm assembly 140 of the second pole unit 3 is illustrated by a solid line, and the guide hole 18 formed in the first contact arm 14a of the contact arm assembly 140 of the first pole unit 2 is illustrated by a dashed line. It is also seen that the stopper 27A (shown by a solid line) integrally extending from the cover 1*b* of the housing 1 is shorter than the stopper of the conventional design (shown by a dot-and-dash line) so that the stopper 27A does not obstruct the movement of the second contact arm 14B which is permitted to rotate over a larger angle because of larger upwardly extending guide hole 18A**.

As a result, when the first contact arm 14A of the second pole unit 3 is to be reset from the repulsion position shown in FIG. 9, the sliding pin 20 of the second pole unit 3 starts to slide along the pin braking surface 180 of the guide hole 18A of the contact arm assembly 140 against the action of the spring 21 on the other hand, the sliding pin 20 in the first pole unit 2 starts to slide along the pin braking surface 180 of the guide hole 18A only after the sliding pin 20 of the second pole unit 3 has left the pin braking surface 180 and moves on the pin sliding surface **18*c* on which the pin 20 can move relatively easily. Therefore, the resetting force necessary for moving the sliding pin 20 from the upper end portion 18*b* to the lower end portion 18*a* of the guide hole 18A** can be significantly reduced.

While the movement of the second contact arm **14*b* in the second pole unit 3 is limited by the stopper 27A extending from the insulating housing cover 1*b* in the above embodiment, this stopper for limiting the movement of the second contact arm 14*b* may be positioned on the base 1*a*. Alternatively, the second contact arm 14*b* may be arranged to abut against the base 1*a*** when it is rotated through a predetermined angle.

Also, while the sliding pin 20 of the second pole unit 3 is the first element to move across the pin braking surface 180 in the above embodiment, it may be made to be the last to move beyond the pin braking surface 180. Also, one of two second pole units 3 provided with no operating mechanism may be made to move earlier than the other.

As has been described, since the longer extension of the guide hole 18A which serves as a time delaying means provides a time delay between the resetting movements of the sliding pins in the first and the second pole units, the sliding pin 20 in the first pole unit 2 with operating mechanism 23 starts sliding along the pin braking surface 180 of the guide hole 18A only after the sliding pin 20 of the second pole unit 3 has left the pin braking surface 180 and moves on the pin sliding surface **18*c* on which the pin 20 can be relatively easily moved. Therefore, the resetting force necessary for moving the sliding pin 20 from the upper end portion 18*b* to the lower end portion 18*a* of the guide hole 18A** for resetting can be significantly reduced.

What is claimed is:

1. A multi-pole circuit interrupter having a first pole unit provided with an operating mechanism and a second pole unit provided with no operating mechanism, said circuit interrupter interrupting current flowing therethrough by separating a movable contact from a stationary contact as a result of an electromagnetic repulsive force generated upon the occurrence of a large overcurrent irrespective of an automatic trip operation of the operating mechanism, each of said first and second pole units comprising:

a movable contact and a stationary contact;

a contact arm assembly for supporting the movable contact of the respective pole unit including a first contact arm and a second contact arm pivotally supported by a common pivot pin;

said first contact arm of said contact arm assembly in said first pole unit having an elongated guide hole extending in a direction of movement of the movable contact of said contact arm assembly and being directly connected to the operating mechanism of said first pole unit;

said first contact arm of said contact arm assembly in said second pole unit being connected to the operating mechanism of said first pole unit through a cross bar;

said second contact arm of said contact arm assembly in both said first and second pole units extending longitudinally and having an elongated hole extending substantially in the longitudinal direction of said second contact arm;

a spring-biased sliding pin extending through the elongated hole and the guide hole of said first and second contact arms of said contact arm assembly;

the guide hole having a pin sliding surface on which said sliding pin slidably moves, and a pin braking surface disposed at an end portion thereof for preventing said sliding pin from being bounced from said end portion of the guide hole upon the electromagnetic repulsive force being exerted on the contact arm assembly; and time delaying means associated with the guide hole of said first contact arm for providing a time delay between a resetting movement of said sliding pin along said pin braking surface of the guide hole in said second pole unit compared with a resetting movement of said sliding pin along said pin braking surface of the guide hole in said first pole unit.

2. A multi-pole circuit interrupter as claimed in claim 1 wherein said time delaying means provides guide holes of said first and said second pole units with different length.

3. A multi-pole circuit interrupter as claimed in claim 1, wherein the guide hole of said first contact arm in said second pole unit extends further upwards than the guide hole of said first contact arm in said first pole unit so that said sliding pin in said first pole unit starts to slide along said pin braking surface of the guide hole only after said sliding pin in said second pole unit has left said pin braking surface and moves on said pin sliding surface.

* * * * *